US008968482B2

(12) United States Patent
Braeckman et al.

(10) Patent No.: US 8,968,482 B2
(45) **Date of Patent: *Mar. 3, 2015**

(54) METHOD FOR HAND WASHING DISHES HAVING LONG LASTING SUDS

(75) Inventors: Karl Ghislain Braeckman, Gerpinnes (BE); Ikram El Idrissi, Brussels (BE); Ashmita Randhawa, Strombeek-Bever (BE); Gang Si, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 17 days.

This patent is subject to a terminal disclaimer.

(21) Appl. No.: 13/210,411

(22) Filed: Aug. 16, 2011

(65) Prior Publication Data

US 2012/0046213 A1 Feb. 23, 2012

(30) Foreign Application Priority Data

Aug. 17, 2010 (WO) ..... PCT/CN2010/001241

(51) Int. Cl.

| | |
|---|---|
| ***B08B 3/04*** | (2006.01) |
| ***C11D 1/29*** | (2006.01) |
| ***C11D 1/72*** | (2006.01) |
| ***C11D 1/83*** | (2006.01) |
| ***C11D 11/00*** | (2006.01) |

(52) U.S. Cl.

CPC .. *C11D 1/72* (2013.01); *C11D 1/83* (2013.01); *C11D 11/0023* (2013.01)

USPC ..... 134/25.2; 134/25.3; 134/39; 134/42; 510/235; 510/421; 510/426; 510/492; 510/505; 510/524; 510/535

(58) Field of Classification Search

USPC ..... 510/235, 421, 426, 492, 505, 524, 535; 134/25.2, 25.3, 39, 42

See application file for complete search history.

(56) References Cited

U.S. PATENT DOCUMENTS

| | | | | |
|---|---|---|---|---|
| 5,968,888 | A | 10/1999 | Blandiaux | |
| 6,008,181 | A | 12/1999 | Cripe et al. | |
| 2005/0107275 | A1 | 5/2005 | Hecht et al. | |
| 2005/0170990 | A1 | 8/2005 | Hecht et al. | |
| 2006/0079433 | A1* | 4/2006 | Hecht et al. | 510/424 |
| 2007/0123447 | A1 | 5/2007 | Killeen et al. | |
| 2009/0048143 | A1 | 2/2009 | Iverson et al. | |
| 2009/0253603 | A1 | 10/2009 | Uchiyama et al. | |
| 2010/0323942 | A1* | 12/2010 | Evers et al. | 510/236 |
| 2011/0152157 | A1* | 6/2011 | Woo et al. | 510/236 |
| 2012/0046214 | A1 | 2/2012 | Braeckman et al. | |

FOREIGN PATENT DOCUMENTS

| | | | |
|---|---|---|---|
| EP | 0 855 438 | A1 | 7/1998 |
| EP | 0 874 041 | A1 | 10/1998 |
| EP | 2 264 138 | A1 | 12/2010 |
| WO | WO 95/07969 | A1 | 3/1995 |
| WO | WO 95/33025 | A1 | 12/1995 |
| WO | WO 98/56884 | A1 | 12/1998 |
| WO | WO 99/19449 | A1 | 4/1999 |
| WO | WO 2006/041740 | A1 | 4/2006 |

OTHER PUBLICATIONS

Extended European Search Report; Application No. 11176992.3-2114; dated Dec. 22, 2011; 5 pages.

Search Report PCT/CN2010/001241; Dated Aug. 17, 2010; 13 Pages.

* cited by examiner

*Primary Examiner* — Brian P Mruk

(74) *Attorney, Agent, or Firm* — Amy I Ahn-Roll

(57) ABSTRACT

The need for a method for hand washing dishes by direct application of an easily pourable liquid detergent composition, that delivers great grease cleaning with an excellent sudsing profile, is met by a liquid hand dishwashing detergent composition comprising small amounts of a branched alkoxylated nonionic surfactant.

6 Claims, No Drawings

METHOD FOR HAND WASHING DISHES HAVING LONG LASTING SUDS

FIELD OF THE INVENTION

The present invention relates to a method for hand washing dishes by applying a neat liquid detergent composition directly onto the dishes or via a sponge. Because of the presence of a branched ethoxylated nonionic surfactant, the liquid detergent compositions deliver effective grease-cleaning with enduring suds, during extended use in direct application methods.

BACKGROUND OF THE INVENTION

While some consumers prefer to wash their dishes by submerging them into diluted liquid detergent compositions, many consumers prefer to apply the neat liquid detergent composition to the dish directly, or via an implement such as a sponge. Direct application provides improved grease cleaning, since a greater concentration of surfactant is applied directly to the stain. For direct application methods, consumers desire long lasting grease cleaning and long lasting sudsing. Previously, such "mileage" was extended by increasing the surfactant level. However, while increasing the surfactant level indeed improves the sudsing profile for the diluted liquid detergent composition, the higher surfactant level leads to poorer initial sudsing during direct application dishwashing. In addition, such liquid detergent compositions have a less desired thick, viscous appearance.

Therefore, a need remains for a method for hand washing dishes by direct application of an easily pourable liquid detergent composition, which results in great grease cleaning, excellent initial sudsing and long-lasting suds.

It has surprisingly been found that liquid hand dishwashing detergent compositions comprising even small amounts of a branched alkoxylated nonionic surfactant provide excellent, long-lasting suds, as well as excellent grease cleaning, when used in direct application methods, while being easily pourable.

WO 9533025, U.S. Pat. No. 5,968,888, and US 2005/0170990 A1 disclose methods for hand washing dishes, including the step of contacting the dishes with the liquid detergent composition in undiluted form. US 2007/0123447 A1, WO 2006/041740 A1, U.S. Pat. No. 6,008,181 disclose dish washing compositions comprising branched surfactants.

SUMMARY OF THE INVENTION

According to the present invention, there is provided a method for hand washing dishes, using a liquid detergent composition comprising from 0.1 to 5% by weight of an alkoxylated branched nonionic surfactant, having an average degree of alkoxylation of from 1 to 40; wherein the method comprises the step of contacting the liquid detergent composition in its neat form, with the dishes. The present invention also provides for the use of a liquid detergent composition comprising from 0.1 to 5% by weight of an alkoxylated branched nonionic surfactant, having an average degree of alkoxylation of from 1 to 40; for providing a long lasting suds profile during direct application hand dishwashing methods.

DETAILED DESCRIPTION OF THE INVENTION

As used herein "liquid hand dishwashing detergent composition" refers to those compositions that are employed in manual (i.e. hand) cleaning of dishes. Such compositions are generally high sudsing or foaming in nature. As used herein "cleaning" means applying the liquid hand dishwashing detergent composition to a surface for the purpose of removing undesired residue such as soil, grease, stains and/or disinfecting.

As used herein "dish", "dishes", and "dishware" means a surface such as dishes, glasses, pots, pans, baking dishes and flatware, made from ceramic, china, metal, glass, plastic (polyethylene, polypropylene, polystyrene, etc.) and wood.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "suds profile" means the amount of sudsing (high or low) and the persistence of sudsing (how sustained or long lasting the suds are) throughout the washing process, resulting from the use of the liquid detergent composition. As used herein "high sudsing" or "long lasting suds" refers to liquid hand dishwashing detergent compositions which both generate a high level of suds (i.e. a level of sudsing considered acceptable to the consumer) and where the level of suds is sustained during the dishwashing operation. This is particularly important with respect to liquid dishwashing detergent compositions as the consumer perceives high sudsing as an indicator of the performance of the detergent composition. Moreover, the consumer also uses the sudsing profile as an indicator that the wash solution still contains active detergent ingredients. The consumer usually applies additional liquid hand dishwashing detergent composition when the suds subside. Thus, low sudsing liquid dishwashing detergent composition formulation will tend to be used by the consumer more frequently than is necessary.

By "in its neat form", it is meant herein that said composition is applied directly onto the surface to be treated, or onto a cleaning device or implement such as a brush, a sponge, a nonwoven material, or a woven material, without undergoing any significant dilution by the user (immediately) prior to application. "In its neat form", also includes slight dilutions, for instance, arising from the presence of water on the cleaning device, or the addition of water by the consumer to remove the remaining quantities of the composition from a bottle. Therefore, the composition in its neat form includes mixtures having the composition and water at ratios ranging from 50:50 to 100:0, preferably 70:30 to 100:0, more preferably 80:20 to 100:0, even more preferably 90:10 to 100:0 depending on the user habits and the cleaning task. For the avoidance of doubt, a ratio of 100:0 is most preferred.

By "diluted form", it is meant herein that said composition is diluted by the user, typically with water. By "rinsing", it is meant herein contacting the dishes cleaned with the composition, with substantial quantities of water after the step of applying the liquid composition onto said dishes.

By "substantial quantities", it is meant usually 1 to 20 liters. All percentages, ratios and proportions used herein are by weight percent of the liquid hand dishwashing detergent composition. All average values are calculated "by weight" of the liquid hand dishwashing detergent composition, unless otherwise expressly indicated.

Method and Use for Hand Washing Dishes

Liquid hand dishwashing detergent compositions can be used to wash dishes by various methods, depending on the level and type of soil or grease, and consumer preference.

The present invention provides for a method of neat application of a liquid detergent composition which comprises the step of contacting said composition in its neat form, with the dish. Said composition may be poured directly onto the dish from its container. Alternatively, the composition may be applied first to a cleaning device or implement such as a brush, a sponge, a nonwoven material, or a woven material. The cleaning device or implement, and consequently the liquid dishwashing composition in its neat form, is then directly contacted to the surface of each of the soiled dishes, to remove said soiling. The cleaning device or implement is typically contacted with each dish surface for a period of time range from 1 to 10 seconds, although the actual time of application will depend upon factors such as the degree of soiling of the dish. The contacting of said cleaning device or implement to the dish surface is preferably accompanied by concurrent scrubbing. Alternatively, the device or implement may be immersed in the liquid hand dishwashing detergent composition in its neat form, in a small container that can accommodate the cleaning device.

Prior to the application of said composition, the soiled dish may be immersed into a water bath, or held under running water, to wet the surface of the dish.

The method may comprise an optional rinsing step, after the step of contacting the liquid detergent composition with the dishes.

The present invention also provides for the use of a liquid detergent composition comprising from 0.1 to 5% by weight of a branched nonionic surfactant, having an average degree of alkoxylation of from 1 to 40, for providing a long lasting suds profile during direct application hand dishwashing methods.

The Liquid Hand Dishwashing Detergent Composition

The liquid hand dishwashing detergent compositions used in the method of the present invention, are formulated to provide long lasting suds in combination with excellent grease cleaning, and optionally other benefits such as soil removal, shine, and hand care. The compositions of the present invention comprise at least one branched, nonionic, alkoxylated surfactant.

The compositions herein may further comprise from 30% to 80% by weight of an aqueous liquid carrier, comprising water, in which the other essential and optional ingredients are dissolved, dispersed or suspended. More preferably, the compositions of use in the present invention comprise from 45% to 70%, more preferable from 45% to 65% of the aqueous liquid carrier. Suitable optional ingredients include additional surfactant selected from ethoxylated anionic surfactants, other anionic surfactants, other nonionic surfactants, amphoteric/zwitterionic surfactants, cationic surfactants, and mixtures thereof; cleaning polymers; cationic polymers; enzymes; humectants; salts; solvents; hydrotropes; polymeric suds stabilizers; diamines; carboxylic acid; pearlescent agent; chelants; pH buffering agents; perfume; dyes; opacifiers; and mixtures thereof.

The aqueous liquid carrier, however, may contain other materials which are liquid, or which dissolve in the liquid carrier, at room temperature (20° C.-25° C.) and which may also serve some other function besides that of an inert filler.

The liquid detergent composition may have any suitable pH. Preferably the pH of the composition is adjusted to between 4 and 14. More preferably the composition has pH of from 6 to 13, most preferably from 6 to 10. The pH of the composition can be adjusted using pH modifying ingredients known in the art.

The liquid detergent composition of the present invention is preferably clear or transparent. That is, the liquid detergent composition has a turbidity of from 5 NTU to less than 3000 NTU, preferably less than 1000 NTU, more preferably less than 500 NTU and most preferably less than 100 NTU.

The Alkoxylated Branched Nonionic, Surfactant

The liquid hand dishwashing detergent compositions of use in the method of the present invention comprise from 0.1% to 5%, preferably from 0.2% to 3%, more preferably from 0.5% to 2% by weight of alkoxylated branched nonionic surfactant. Said alkoxylated branched nonionic surfactant has an average degree of alkoxylation of from 1 to 40, preferably from 3 to 20 more preferably from 7 to 12 The average degree of alkoxylation is defined as the average number of moles of alkyl oxide per mole of the alkoxylated branched nonionic surfactant of the present invention. Preferably the branched nonionic is ethoxylated and/or propoxylated, more preferably ethoxylated.

Non-ethoxylated branched nonionic surfactants in combination with the ethoxylated anionic surfactant of the present compositions have been found to limit the sudsing performance of the liquid detergent composition. Therefore, the composition preferably comprises less than 10%, more preferably less than 5%, most preferably less than 2% by weight of non-alkoxylated branched alcohol. For the surfactant to be suitably surface-active, the branched nonionic surfactant preferably comprises from 8 to 24, more preferably from 9 to 18, most preferably from 10 to 14 carbon atoms. Alkoxylated branched nonionic alcohols selected from: formula I, formula II, and mixtures thereof; are particularly preferred:

Formula I:

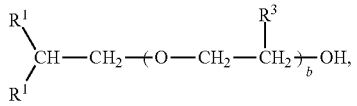

wherein, in formula I:

R1 is a C5 to C16 linear or branched, preferably linear, alkyl chain;

R2 is a C1 to C8 linear or branched, preferably linear, alkyl chain;

R3 is H or C1 to C4 alkyl, preferably H or methyl;

b is a number from 1 to 40, preferably from 5 to 20, more preferably from 7 to 12;

Formula II:

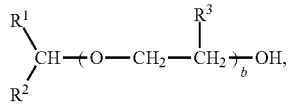

wherein, in formula II:

R1 is a C6 to C16 linear or branched, preferably linear, alkyl chain;

R2 is a C1 to C8 linear or branched, preferably linear, alkyl chain;

R3 is H or C1 to C4 alkyl, preferably H or methyl;

b is a number from 1 to 40, preferably from 5 to 20, more preferably from 7 to 12.

The degree of alkoxylation of said branched nonionic is preferably greater than the degree of ethoxylation of the ethoxylated anionic surfactant, if present. As the degree of ethoxylation of the anionic surfactant is increased, the viscosity of the liquid hand dishwashing detergent composition increases. It is believed that this is because the hydrophilicity of the total surfactant system is increased. Moreover, liquid hand dishwashing detergent compositions are generally made using surfactant premixes. As the degree of ethoxylation of the anionic surfactant is increased, the likelihood of such surfactant premixes gelling during processing is increased. However, it has been discovered that by incorporating a small amount of branched nonionic surfactant, having a higher degree of alkoxylation than the degree of ethoxylation of the anionic surfactant, the viscosity of the surfactant premix, and resultant composition, can be controlled. Alkoxylated branched nonionic surfactants can be classified as relatively water insoluble or relatively water soluble. While certain alkoxylated branched nonionic surfactants can be considered water-insoluble, they can be formulated into liquid hand dishwashing detergent compositions of the present invention using suitable additional surfactants, particularly anionic or nonionic surfactants.

Preferred branched nonionic surfactants according to formula I are the Guerbet C10 alcohol ethoxylates with 7 or 8 EO, such as Ethylan® 1007 & 1008, and the Guerbet C10 alcohol alkoxylated nonionic surfactants (which are ethoxylated and/or propoxylated) such as the commercially available Lutensol® XL series (X150, XL70. etc). Other exemplary alkoxylated branched nonionic surfactants include those available under the trade names: Lutensol® XP30, Lutensol® XP-50, and Lutensol® XP-80 available from BASF Corporation. In general, Lutensol®XP-30 can be considered to have 3 repeating ethoxy groups, Lutensol® XP-50 can be considered to have 5 repeating ethoxy groups, and Lutensol XP-80 can be considered to have 8 repeating ethoxy groups. Other suitable branched nonionic surfactants include oxo branched nonionic surfactants such as the Lutensol® ON 50 (5 EO) and Lutensol® ON70 (7 EO). Also suitable are: the ethoxylated fatty alcohols originating from the Fischer & Tropsch reaction comprising up to 50% branching (40% methyl (mono or bi), 10% cyclohexyl) such as those produced from the Safol® alcohols from Sasol; ethoxylated fatty alcohols originating from the oxo reaction wherein at least 50% by weight of the alcohol is C2 isomer (methyl to pentyl) such as those produced from the Isalchem® alcohols or Lial® alcohols from Sasol.

Preferred branched non-ionic ethoxylates according to formula II are those available under the tradenames Tergitol® 15-S, with an alkoxylation degree of from 3 to 40. For instance Tergitol® 15-S-20 which has an average degree of alkoxylation of 20. Other suitable commercially available material according to formula II are the ones available under the tradename Softanol® M and EP series.

Additional Surfactants

The composition of use in the present invention may comprise additional surfactant selected from ethoxylated anionic, other anionic, other nonionic, amphoteric/zwitterionic, cationic surfactants, and mixtures thereof. The liquid hand dishwashing compositions of use in the present invention may comprise a total amount of surfactant of from 10% to 85% by weight, preferably from 12.5% to 65% by weight, more preferably 15% to 40% by weight of the composition. The total amount of surfactant is the sum of all the surfactants present, including the alkoxylated branched nonionic surfactant, and any ethoxylated anionic surfactant, other anionic, other nonionic, amphoteric/zwitterionic, and cationic surfactants that may be present.

1) Ethoxylated Anionic Surfactant

The liquid hand dishwashing detergent composition of use in the method of the invention may comprise from 2% to 70%, preferably from 5% to 30%, more preferably from 10% to 25% by weight of anionic surfactant having an average degree of ethoxylation of from 0.8 to 4, preferably from 1 to 2. The average degree of ethoxylation is defined as the average number of moles of ethylene oxide per mole of the ethoxylated anionic surfactant of the present invention. When used, the ethoxylated anionic surfactant is derived from a fatty alcohol, wherein at least 80%, preferably at least 82%, more preferably at least 85%, most preferably at least 90% by weight of said fatty alcohol is linear. By linear, what is meant is that the fatty alcohol comprises a single backbone of carbon atoms, with no branches.

Preferably, said ethoxylated anionic surfactant is an ethoxylated alkyl sulphate surfactant of formula:

$R_1—(OCH_2CH_2)_n—O—SO_3^-M^+$, wherein:

$R_1$ is a saturated or unsaturated $C_8$-$C_{16}$, preferably $C_{12}$-$C_{14}$ alkyl chain; preferably, $R_1$ is a saturated $C_8$-$C_{16}$, more preferably a saturated $C_{12}$-$C_{14}$ alkyl chain;

n is a number from 0.8 to 4, preferably from 1 to 2;

$M^+$ is a suitable cation which provides charge neutrality, preferably sodium, calcium, potassium, or magnesium, more preferably a sodium cation.

Suitable ethoxylated alkyl sulphate surfactants include saturated $C_8$-$C_{16}$ alkyl ethoxysulphates, preferably saturated $C_{12}$-$C_{14}$ alkyl ethoxysulphates.

The proportion of $R_1$ that is linear is such that at least 80% by weight of the starting fatty alcohol is linear. Saturated alkyl chains are preferred, since the presence of double bonds can lead to chemical reactions with other ingredients, such as certain perfume ingredients, or even with uv-light. Such reactions can lead to phase instabilities, discoloration and malodour.

The required carbon chain length distribution can be obtained by using alcohols with the corresponding chain length distribution prepared synthetically or from natural raw materials or corresponding pure starting compounds. Preferably, the anionic surfactant of the present invention is derived from a naturally sourced alcohol. Natural sources, such as plant or animal esters (waxes), can be made to yield linear chain alcohols with a terminal (primary) hydroxyl, along with varying degrees of unsaturation. Such fatty alcohols comprising alkyl chains ranging from $C_8$ to $C_{16}$, may be prepared by any known commercial process, such as those deriving the fatty alcohol from fatty acids or methyl esters, and occasionally triglycerides. For example, the addition of hydrogen into the carboxyl group of the fatty acid to the form fatty alcohol, by treating with hydrogen under high pressure and in the presence of suitable metal catalysts. By a similar reaction, fatty alcohols can be prepared by the hydrogenation of glycerides or methyl esters. Methyl ester reduction is a suitable means of providing saturated fatty alcohols, and selective hydrogenation with the use of special catalysts such as copper or cadmium oxides can be used for the production of oleyl alcohol. Synthetic or petroleum-based processes, such as the Ziegler process, are useful for producing suitable straight chain, even-numbered, saturated alcohols. Paraffin oxidation is a suitable process for making mixed primary alcohols. The fatty alcohol may be reacted with ethylene oxide to yield ethoxylated fatty alcohols. The ethoxylated alkyl sulphate surfactant(s) of formula $R_1—(OCH_2CH_2)_n—O—SO_3^-M^+$ may then be obtained by the sulphonation of the corresponding ethoxylated fatty alcohol(s).

Ethoxylated alkyl sulphate surfactant(s) of formula $R_1—(OCH_2CH_2)_n—O—SO_3^-M^+$, may be derived from coconut oil. Coconut oil usually comprises triglycerides which can be chemically processed to obtain a mixture of $C_{12}$-$C_{18}$ alcohols. A mixture of alkyl sulphates comprising a higher proportion of $C_{12}$-$C_{14}$ alkyl sulphates may be obtained by separating the corresponding alcohols before the ethoxylation or sulphation step, or by separating the obtained ethoxylated alcohol or ethoxylated alkyl sulphate surfactant(s).

Preferred ethoxylated anionic surfactants herein are ethoxylated alkyl sulphates having from 8 to 18, preferably 10 to 16, more preferably 12 to 14 carbon atoms in the alkyl chain, and are from 80% to 100% linear. Such surfactants can be made by any known processes, using suitable feedstock. For instance, from linear fatty alcohols which are preferably naturally derived, such as n-dodecanol, n-tetradecanol and mixtures thereof. If desired, such surfactants can contain linear alkyl moieties derived from synthetic sources, or can comprise mixtures of the linear ethoxylated alkyl sulphates with lightly branched, e.g., methyl branched analogues. The ethoxylated alkyl sulphates can be in the form of their sodium, potassium, ammonium or alkanolamine salts. Suitable alcohol precursors for the ethoxylated anionic surfactants include Ziegler-derived linear alcohols, alcohols prepared by hydrogenation of oleochemicals, and 80% or more linear alcohols prepared by enrichment of the linear component of oxo derive alcohols, such as Neodol® or Dobanol® from Shell. Other examples of suitable primary alcohols include those derived from: natural linear fatty alcohols such as those commercially available from Procter & Gamble Co.; and the oxidation of paraffins by the steps of (a) oxidizing the paraffin to form a fatty carboxylic acid; and (b) reducing the carboxylic acid to the corresponding primary alcohol. Other preferred ethoxylated anionic surfactants are those from Sasol, sold under the tradenames: Alfol®, Nacol®, Nalfol®, Alchem®.

2) Other Anionic Surfactants:

The compositions for use in the method of the present invention will typically comprise 2% to 70%, preferably 5% to 30%, more preferably 7.5% to 25%, and most preferably 10% to 20% by weight of an anionic surfactant.

Suitable anionic surfactants of use in the compositions of the method of the present invention are sulphates, sulphosuccinates, sulphonates, and/or sulphoacetates; preferably alkyl sulphates.

Suitable sulphate or sulphonate surfactants for use in the compositions herein include water-soluble salts or acids of $C_{10}$-$C_{14}$ alkyl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises $C_{1-4}$ alkyl branching units.

The sulphate or sulphonate surfactants may be selected from $C_{11}$-$C_{18}$ alkyl benzene sulphonates (LAS), $C_8$-$C_{20}$ primary, branched chain and random alkyl sulphates (AS); $C_{10}$-$C_{18}$ secondary (2,3) alkyl sulphates; mid-chain branched alkyl sulphates as discussed in U.S. Pat. No. 6,020,303 and U.S. Pat. No. 6,060,443; modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS).

The paraffin sulphonates may be monosulphonates or disulphonates and usually are mixtures thereof, obtained by sulphonating paraffins of 10 to 20 carbon atoms. Preferred sulphonates are those of C12-18 carbon atoms chains and more preferably they are C14-17 chains. Paraffin sulphonates that have the sulphonate group(s) distributed along the paraffin chain are described in U.S. Pat. No. 2,503,280; U.S. Pat. No. 2,507,088; U.S. Pat. No. 3,260,744; U.S. Pat. No. 3,372,188 and in DE 735 096.

Also suitable are the alkyl glyceryl sulphonate surfactants and/or alkyl glyceryl sulphate surfactants described in the Procter & Gamble patent application WO06/014740: A mixture of oligomeric alkyl glyceryl sulphonate and/or sulphate surfactant selected from dimers, trimers, tetramers, pentamers, hexamers, heptamers, and mixtures thereof; wherein the weight percentage of monomers is from 0 wt % to 60 wt % by weight of the alkyl glyceryl sulphonate and/or sulphate surfactant mixture.

Other suitable anionic surfactants are alkyl, preferably dialkyl sulphosuccinates and/or sulphoacetates. The dialkyl sulphosuccinates may be a $C_{6-15}$ linear or branched dialkyl sulphosuccinates. The alkyl moieties may be symmetrical (i.e., the same alkyl moieties) or asymmetrical (i.e., different alkyl moieties). Preferably, the alkyl moiety is symmetrical.

3) Other Nonionic Surfactants

The liquid hand dishwashing detergent compositions for use in the method of the present invention may optionally comprise additional nonionic surfactant. The composition preferably comprises from 2% to 40%, more preferably from 3% to 30% by weight of nonionic surfactant. Suitable additional nonionic surfactants include the condensation products of aliphatic alcohols having from 1 to 25 moles of ethylene oxide. The alkyl chain of the aliphatic alcohol generally contains from 8 to 22 carbon atoms. Particularly preferred are the condensation products of alcohols having an alkyl group containing from 8 to 18 carbon atoms, more preferably from 9 to 15 carbon atoms, with from 2 to 18 moles, more preferably from 2 to 15 moles, most preferably from 5 to 12 moles of ethylene oxide per mole of alcohol.

Also suitable are alkylpolyglycosides having the formula $R^2O(C_nH_{2n}O)_t(\text{glycosyl})_x$ (formula (I)), wherein $R^2$ of formula (I) is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n of formula (I) is 2 or 3, preferably 2; t of formula (I) is from 0 to 10, preferably 0; and x of formula (I) is from 1.3 to 10, preferably from 1.3 to 3, most preferably from 1.3 to 2.7. The glycosyl is preferably derived from glucose. Also suitable are alkyl glycerol ethers and sorbitan esters.

Also suitable are fatty acid amide surfactants having the formula (II):

$$R^6\overset{\overset{\displaystyle O}{\|}}{C}N(R^7)_2 \qquad \text{(II)}$$

wherein $R^6$ of formula (II) is an alkyl group containing from 7 to 21, preferably from 9 to 17, carbon atoms and each $R^7$ of formula (II) is selected from the group consisting of hydrogen, $C_1$-$C_4$ alkyl, $C_1$-$C_4$ hydroxyalkyl, and $—(C_2H_4O)_xH$ where x of formula (II) varies from 1 to 3. Preferred amides are $C_8$-$C_{20}$ ammonia amides, monoethanolamides, diethanolamides, and isopropanolamides.

Preferred nonionic surfactants for use in the present invention are the condensation products of aliphatic alcohols with ethylene oxide, such as the mixture of nonyl (C9), decyl (C10) undecyl (C11) alcohol modified with on average 5 ethylene oxide (EO) units such as the commercially available Neodol 91-5 or the Neodol 91-8 that is modified with on average 8 EO units. Also suitable are the longer alkyl chain ethoxylated nonionic surfactants such as C12, C13 modified with 5 EO (Neodol 23-5). Neodol is a Shell tradename. Also suitable is the C12, $C_{1-4}$ alkyl chain with 7 EO, commercially available under the trade name Novel 1412-7 (Sasol) or the Lutensol A 7 N (BASF)

4) Amphoteric/Zwitterionic Surfactants

It has been found that amphoteric/zwitterionic surfactants further enhance the sudsing profile, while providing excellent cleaning and being mild on the hands. The amphoteric and zwitterionic surfactant can be comprised at a level of from 0.01% to 20%, preferably from 0.2% to 15%, more preferably 0.5% to 10% by weight of the liquid hand dishwashing detergent compositions. Preferred amphoteric and zwitterionic surfactants are amine oxide surfactants, betaine surfactants, and mixtures thereof.

Most preferred are amine oxides, especially coco dimethyl amine oxide or coco amido propyl dimethyl amine oxide. Amine oxide may have a linear or mid-branched alkyl moiety. Typical linear amine oxides include water-soluble amine oxides of formula $R^1—N(R^2)(R^3)\rightarrow(O)$ wherein $R^1$ is a $C_{8-18}$ alkyl moiety; $R^2$ and $R^3$ are independently selected from the group consisting of $C_{1-3}$ alkyl groups and $C_{1-3}$ hydroxyalkyl groups and preferably include methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably less than 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from 1 to 3 ethylene oxide groups. Preferably the two moieties are selected from a $C_{1-3}$ alkyl, more preferably both are selected as a $C_1$ alkyl.

Other suitable surfactants include betaines such as: alkyl betaines, alkylamidobetaines, amidazoliniumbetaines, sulphobetaines (INCI Sultaines) and phosphobetaines, that preferably meets formula (III):

$$R^1—[CO—X(CH_2)_n]_x—N^+(R^2)(R^3)—(CH_2)_m—[CH(OH)—CH_2]_y—Y— \quad \text{(III) wherein}$$

- $R^1$ is a saturated or unsaturated $C_{6-22}$ alkyl chain, preferably a $C_{8-18}$ alkyl chain, more preferably a saturated $C_{10-16}$ alkyl chain, most preferably a saturated $C_{12-14}$ alkyl chain;
- X is selected from the group consisting of: NH, $NR^4$, O, and S; wherein $R^4$ is a $C_{1-4}$ Alkyl chain;
- n is an integer from 1 to 10, preferably from 2 to 5, more preferably 3;
- x is either 0 or 1, preferably 1;
- $R^2$, $R^3$ are independently selected from $C_{1-4}$ alkyl chains, preferably a methyl chain; $R^2$, $R^3$ may also be hydroxy substituted such as hydroxyethyl or hydroxymethyl chain;
- m is an integer from 1 to 4, preferably 1, 2 or 3;
- y is either 0 or 1; and
- Y is selected from the group consisting of: COO, SO3, $OPO(OR^5)O$ and $P(O)(OR^5)O$; wherein $R^5$ is H or a $C_{1-4}$ alkyl chain.

Preferred betaines are the alkyl betaines of the formula (IIIa), the alkyl amido betaine of the formula (IIIb), the sulphobetaines of the formula (IIIc) and the amido sulphobetaine of the formula (IIId);

$$R^1—N^+(CH_3)_2—CH_2COO^- \quad \text{(IIIa)}$$

$$R^1—CO—NH(CH_2)_3—N^+(CH_3)_2—CH_2COOO^- \quad \text{(IIIb)}$$

$$R^1—N^+(CH_3)_2—CH_2CH(OH)CH_2SO_3— \quad \text{(IIIc)}$$

$$R^1—CO—NH—(CH_2)_3—N^+(CH_3)_2—CH_2CH(OH)CH_2SO_3— \quad \text{(IIId)}$$

in which $R^1$ has the same meaning as in formula III. Particularly preferred betaines are the carbobetaines [wherein $Y^-$=$COO^-$], in particular the carbobetaine of the formula (IIIa) and (IIIb), more preferred are the alkylamidobetaines of the formula (IIIb).

Examples of suitable betaines and sulphobetaine are the following [designated in accordance with INCI]: Almondamidopropyl of betaines, Apricotamidopropyl betaines, Avocadamidopropyl of betaines, Babassuamidopropyl of betaines, Behenamidopropyl betaines, Behenyl of betaines, betaines, Canolamidopropyl betaines, Capryl/Capramidopropyl betaines, Carnitine, Cetyl of betaines, Cocamidoethyl of betaines, Cocamidopropyl betaines, Cocamidopropyl Hydroxysultaine, Coco betaines, Coco Hydroxysultaine, Coco/Oleamidopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucamidopropyl Hydroxysultaine, Hydrogenated Tallow of betaines, Isostearam idopropyl betaines, Lauramidopropyl betaines, Lauryl of betaines, Lauryl Hydroxysultaine, Lauryl Sultaine, Milkamidopropyl betaines, Minkamidopropyl of betaines, Myristamidopropyl betaines, Myristyl of betaines, Oleamidopropyl betaines, Oleamidopropyl Hydroxysultaine, Oleyl of betaines, Olivamidopropyl of betaines, Palmam idopropyl betaines, Palm itam idopropyl betaines, Palmitoyl Carnitine, Palm Kernelamidopropyl betaines, Polytetrafluoroethylene Acetoxypropyl of betaines, Ricinoleamidopropyl betaines, Sesam idopropyl betaines, Soyamidopropyl betaines, Stearamidopropyl betaines, Stearyl of betaines, Tallowamidopropyl betaines, Tallowamidopropyl Hydroxysultaine, Tallow of betaines, Tallow Dihydroxyethyl of betaines, Undecylenamidopropyl betaines and Wheat Germamidopropyl betaines.

A preferred betaine is, for example, Cocoamidopropyl betaine (Cocoamidopropyl betaine).

A preferred surfactant system is a mixture of anionic surfactant and amphoteric or zwitterionic surfactants in a ratio within the range of 1:1 to 5:1, preferably from 1:1 to 3.5:1.

5) Cationic Surfactants

Cationic surfactants, when present in the composition, are present in an effective amount, more preferably from 0.1% to 20%, by weight of the composition. Suitable cationic surfactants are quaternary ammonium surfactants, preferably selected from mono $C_6$-$C_{16}$, more preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

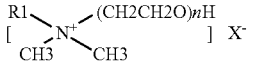

(V)

wherein $R^1$ of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and $X^-$ of formula (V) is an anion, preferably, chloride or bromide.

Cleaning Polymers

The liquid hand dishwashing composition herein may optionally further comprise one or more alkoxylated polyethyleneimine polymer. The composition may comprise from 0.01% to 10%, preferably from 0.01% to 2%, more preferably from 0.1% to 1.5%, even more preferable from 0.2% to 1.5% by weight of the total composition of an alkoxylated polyethyleneimine polymer as described on page 2, line 33 to page 5, line 5 and exemplified in examples 1 to 4 on pages 5 to 7 of WO2007/135645 The Procter & Gamble Company.

The modified polyethyleneimine polymer of the present composition has a polyethyleneimine backbone having a weight average molecular weight of from 400 to 10000, preferably from 600 to 7000 weight, more preferably from 3000 to 6000.

The modification of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom by a polyalkoxylene chain having an average of 1 to 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety and one or two alkoxylation modifications per nitrogen atom, dependent on whether the substitution occurs at an internal nitrogen atom or at a terminal nitrogen atom, in the polyethyleneimine backbone, the alkoxylation modification consisting of the replacement of a hydrogen atom by a polyalkoxylene chain having an average of 1 to 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000, as described in BASF patent application WO2007/138053 on pages 2 line 14 to page 10, line 34 and exemplified on pages 15-18.

Cationic Polymers

In a preferred embodiment, the liquid hand dishwashing compositions herein may comprise at least one cationic polymer. Without wishing to be bound by theory, it is believed that the interaction of the cationic polymer with the anionic surfactant results in a phase separation phenomena known as coacervation where a polymer-rich coacervate phase separates from the bulk phase of the composition. Coacervation enhances the deposition of the cationic polymer on the skin and aids on the deposition of other actives such as hydrophobic emollient materials that might be trapped in this coacervate phase and as such co-deposit on the skin. This coacervate phase can exist already within the liquid hand dishwashing detergent, or alternatively can be formed upon dilution or rinsing of the cleaning composition.

The cationic polymer will typically be present a level of from 0.001% to 10%, preferably from 0.01% to 5%, more preferably from 0.05% to 1% by weight of the total composition.

Suitable cationic polymers for use in the current invention comprise cationic nitrogen containing moieties such as quaternary ammonium or cationic protonated amino moieties. The average molecular weight of the cationic polymer is between 5000 to 10 million, preferably at least 100000, more preferably at least 200000, but preferably not more than 3000000. The cationic polymer preferably has a cationic charge density of from 0.1 meq/g to 5 meq/g, more preferably at least about 0.2 meq/g, more preferably at least about 0.3 meq/g, at the pH of intended use of the composition. The charge density is calculated by dividing the number of net charges per repeating unit by the molecular weight of the repeating unit. The positive charges could be located on the backbone of the polymers and/or the side chains of polymers. In general, adjustments of the proportions of amine or quaternary ammonium moieties in the polymer in function of the pH of the liquid dishwashing liquid in the case of amines, will affect the charge density. Any anionic counterions can be used in association with cationic deposition polymers, so long as the polymer remains soluble in water and in the composition of the present invention, and so long that the counterion is physically and chemically stable with the essential components of the composition, or do not unduly impair product performance, stability nor aesthetics. Non-limiting examples of such counterions include halides (e.g. chlorine, fluorine, bromine, and iodine), sulphate and methylsulphate.

Specific examples of the water soluble cationized polymer include cationic polysaccharides such as cationized cellulose derivatives, cationized starch and cationized guar gum derivatives. Also included are synthetically derived copolymers such as homopolymers of diallyl quaternary ammonium salts, diallyl quaternary ammonium salt/acrylamide copolymers, quaternized polyvinylpyrrolidone derivatives, polyglycol polyamine condensates, vinylimidazolium trichloride/vinylpyrrolidone copolymers, dimethyldiallylammonium chloride copolymers, vinylpyrrolidone/quaternized dimethylaminoethyl methacrylate copolymers, polyvinylpyrrolidone/alkylamino acrylate copolymers, polyvinylpyrrolidone/alkylamino acrylate/vinylcaprolactam copolymers, vinylpyrrolidone/methacrylamidopropyl trimethylammonium chloride copolymers, alkylacrylamide/acrylate/alkylaminoalkylacrylamide/polyethylene glycol methacrylate copolymers, adipic acid/dimethylaminohydroxypropyl ethylenetriamine copolymer ("Cartaretin"—product of Sandoz/USA), and optionally quaternized/protonated condensation polymers having at least one heterocyclic end group connected to the polymer backbone through a unit derived from an alkylamide, the connection comprising an optionally substituted ethylene group (as described in WO 2007 098889, pages 2-19)

Specific non-limiting examples of commercial water soluble cationized polymers described generally above include: "Merquat 550" (a copolymer of acrylamide and diallyl dimethyl ammonium salt—CTFA name: Polyquaternium-7, product of ONDEO-NALCO), "Luviquat FC370" (a copolymer of 1-vinyl-2-pyrrolidone and 1-vinyl-3-methylimidazolium salt—CTFA name: Polyquaternium-16, product of BASF), "Gafquat 755N" (a copolymer of 1-vinyl-2-pyrrolidone and dimethylaminoethyl methacrylate—CTFA name: Polyquaternium-11, product ex ISP), "Polymer KG, "Polymer JR series" and "Polymer LR series" (salt of a reaction product between trimethyl ammonium substituted epoxide and hydroxyethyl cellulose—CTFA name:

Polyquaternium-10, product of Amerchol) and "Jaguar series" (guar hydroxypropyl trimonium chloride, product of Rhodia) or "N-hance series" (guar hydroxypropyl trimonium chloride, product of Aqualon)

Preferred cationic polymers are cationic polysaccharides, more preferably cationic cellulose derivatives such as the salts of hydroxyethyl cellulose reacted with trimethyl ammonium substituted epoxide, referred to in the industry (CTFA) as Polyquaternium-10, such as the UCARE LR400, or UCARE JR-400 ex Dow Amerchol, even more preferred are cationic guar gum derivatives such as guar hydroxypropyltrimonium chloride, such as the Jaguar series ex Rhodia and N-Hance polymer series available from Aqualon.

Enzymes

Enzymes may be incorporated into compositions for use in the method of the present invention, at a level of from 0.00001% to 1% of enzyme protein by weight of the total composition, preferably at a level of from 0.0001% to 0.5% of enzyme protein by weight of the total composition, more preferably at a level of from 0.0001% to 0.1% of enzyme protein by weight of the total composition.

In a preferred embodiment the composition of the present invention may comprise an enzyme, preferably a protease and/or an amylase.

Protease of microbial origin is preferred. Chemically or genetically modified mutants are included. The protease may be a serine protease, preferably an alkaline microbial protease or a trypsin-like protease.

Preferred proteases for use herein include polypeptides demonstrating at least 90%, preferably at least 95%, more preferably at least 98%, even more preferably at least 99% and especially 100% identity with the wild-type enzyme from *Bacillus lentus* or the wild-type enzyme from *Bacillus amyloliquefaciens*.

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, and those sold under the tradename Opticlean® and Optimase® by Solvay Enzymes. In one aspect, the preferred protease is a subtilisin BPN' protease derived from *Bacillus amyloliquefaciens*, preferably comprising the Y217L mutation, sold under the tradename Purafect Prime®, supplied by Genencor International.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022, 334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183*and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:7 in U.S. Pat. No. 6,093,562), especially those comprising one or more of the following mutations M202, M208, S255, R172, and/or M261. Preferably said amylase comprises one or more of M202L, M202V, M2025, M202T, M2021, M202Q, M202W, S255N and/or R172Q. Particularly preferred are those comprising the M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS® and mixtures thereof.

Humectants

In a preferred embodiment the compositions may comprise one or more humectants. It has been found that such composition comprising a humectant will provide additional hand skin mildness benefits.

When present, the humectant will typically be present in the composition of use in the present invention at a level of from 0.1% to 50%, preferably from 1% to 20%, more preferably from 1% to 10%, even more preferably from 1% to 6%, and most preferably from 2% to 5% by weight of the total composition.

Humectants that can be used according to this invention include those substances that exhibit an affinity for water and help enhance the absorption of water onto a substrate, preferably skin. Specific non-limiting examples of particularly suitable humectants include glycerol, diglycerol, polyethyleneglycol (PEG-4), propylene glycol, hexylene glycol, butylene glycol, (di)-propylene glycol, glyceryl triacetate, polyalkyleneglycols, and mixtures thereof. Others can be polyethylene glycol ether of methyl glucose, pyrrolidone carboxylic acid (PCA) and its salts, pidolic acid and salts such as sodium pidolate, polyols like sorbitol, xylitol and maltitol, or polymeric polyols like polydextrose or natural extracts like quillaia, or lactic acid or urea. Also included are alkyl polyglycosides, polybetaine polysiloxanes, and mixtures thereof. Additional suitable humectants are polymeric humectants of the family of water soluble and/or swellable polysaccharides such as hyaluronic acid, chitosan and/or a fructose rich polysaccharide which is e.g. available as Fucogel®1000 (CAS-Nr 178463-23-5) by SOLABIA S.

Electrolytes and Chelants

It is preferable to limit electrolytes or chelants to less than 5%, preferably from 0.015% to 3%, more preferably from 0.025% to 2.0%, by weight of the liquid detergent composition. Electrolytes are water-soluble mono or polyvalent non-surface active (i.e. non-surfactant) salts that are capable of affecting the phase behaviour of aqueous surfactants. Such electrolytes include the chloride, sulphate, nitrate, acetate, and citrate salts of sodium, potassium, and ammonium.

Chelants are used to bind or complex with metal ions, including transition metal ions, that can have a detrimental effect on the performance and stability of surfactant systems, for instance, leading to precipitation or scale formation. By sequestering ions such as calcium and magnesium ions, they also inhibit crystal growth that can result in streaking during drying. However, chelants are also capable of affecting the phase behaviour of aqueous surfactants.

Chelants include amino carboxylates, amino phosphonates, poly-functionally-substituted aromatic chelating agents and mixtures thereof. Examples of chelants include: MEA citrate, citric acid, aminoalkylenepoly(alkylene phosphonates), alkali metal ethane 1-hydroxy disphosphonates, and nitrilotrimethylene, phosphonates, diethylene triamine penta (methylene phosphonic acid) (DTPMP), ethylene diamine tetra(methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine disuccinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), and mixtures thereof.

Solvents

Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition of use in the method of the present invention will contain from 0.01% to 20%, preferably from 0.5% to 20%, more preferably from 1% to 10% by weight of the liquid detergent composition of a solvent. These solvents may be used in conjunction with an aqueous liquid carrier, such as water, or they may be used without any aqueous liquid carrier being present.

Hydrotropes

The liquid detergent compositions for use in the method of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903. The liquid detergent compositions of the present invention typically comprise from 0% to 15% by weight of the total liquid detergent composition of a hydrotrope, or mixtures thereof, preferably from 1% to 10%, most preferably from 3% to 10% by weight of the total liquid hand dishwashing composition.

Polymeric Suds Stabilizers

The compositions may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt.

One preferred polymeric suds stabilizer is (N,N-dimethylamino)alkyl acrylate esters. Other preferred suds boosting polymers are copolymers of hydroxypropylacrylate/dimethyl aminoethylmethacrylate (copolymer of HPA/DMAM).

When present in the compositions, the polymeric suds booster/stabilizer may be present from 0.01% to 15%, preferably from 0.05% to 10%, more preferably from 0.1% to 5%, by weight of the liquid detergent composition.

Another preferred class of polymeric suds booster polymers is hydrophobically modified cellulosic polymers having a number average molecular weight (Mw) below 45,000; preferably between 10,000 and 40,000; more preferably between 13,000 and 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

Diamines

Another optional ingredient of the compositions is a diamine. Since the habits and practices of the users of liquid detergent compositions show considerable variation, the composition may contain 0% to 15%, preferably 0.1% to 15%, preferably 0.2% to 10%, more preferably 0.25% to 6%, more preferably 0.5% to 1.5% by weight of said composition of at least one diamine. Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EPC)) (pK1=10.5; pK2=8.9), 2-methyl 1,5 pentane diamine (DYTEK AC)) (pK1=11.2; pK2=10.0). Other preferred materials include primary/primary diamines with alkylene spacers ranging from $C_4$ to $C_8$.

Carboxylic Acid

The liquid detergent compositions may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishes. This feeling of slipperiness is reduced when using the carboxylic acids as defined herein i.e. the rinse feel becomes slippery.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2, 4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5%, by weight of the total composition.

Viscosity

The compositions of the present invention preferably have a viscosity of from 50 to 4000 centipoises (50 to 4000 mPa*s), more preferably from 100 to 2000 centipoises (100 to 2000 mPa*s), and most preferably from 500 to 1500 centipoises (500 to 1500 mPa*s) at 20 $s^{-1}$ and 20° C. Viscosity according to the present invention is measured using an AR 550 rheometer from TA instruments using a plate steel spindle at 40 mm diameter and a gap size of 500 μm. The high shear viscosity at 20 $s^{-1}$ and low shear viscosity at 0.05 $s^{-1}$ can be obtained from a logarithmic shear rate sweep from 0.1 $s^{-1}$ to 25 $s^{-1}$ in 3 minutes time at 20° C. The preferred rheology described therein may be achieved using internal existing structuring with detergent ingredients or by employing an external rheology modifier. Hence, in a preferred embodiment of the present invention, the composition comprises further a rheology modifier.

Turbidity (NTU) Measurement

The turbidity (measured in NTU: Nephelometric Turbidity Units) is measured using a Hach 2100P turbidity meter calibrated according to the procedure provided by the manufacture. The sample vials are filled with 15 ml of representative sample and capped and cleaned according to the operating instructions. If necessary, the samples are degas sed to remove any bubbles either by applying a vacuum or using an ultrasonic bath (see operating manual for procedure). The turbidity is measured using the automatic range selection.

EXAMPLES

The suds longevity during direct application usage was evaluated versus a reference detergent by adding 4 grams of the undiluted composition directly on a pre-wetted sponge of polyurethane material, which was then used by panellists to clean plates soiled with 4 grams of consumer average beef fat (CABF). The panellists washed a number of soiled plates under a running tap until suds were no longer generated on the sponge. The number of washed plates was recorded and compared to that from using the reference composition.

The reference composition does not comprise the branched ethoxylated alcohol of the invention. Example 1 contains a branched alkoxylated alcohol according to the invention. It has been found that the composition of the present invention, despites a lower level of surfactants (alkyl ethoxy sulphate and amine oxide) provides significantly improved suds longevity.

| Wt % | Ref | Ex. 1 |
|---|---|---|
| Alkyl $C_{10-14}$ $Ethoxy_{0.6}$ Sulfate | 22.6 | 17.9 |
| C12-14 dimethyl amine oxide | 5.1 | 4.1 |
| Branched Nonionic: | | |
| 3-propyl heptanol EO8 | — | 1.0 |
| PEI600-EO10-PO7 block polymer | 0.4 | 0.4 |
| Propylene glycol | — | — |
| Polypropylene glycol MW2000 | 0.5 | 0.5 |
| Sodium Chloride | 1.0 | 1.0 |

-continued

| Wt % | Ref | Ex. 1 |
|---|---|---|
| Minors* and water balance to 100% | | |
| Performance: | | |
| Suds endurance (direct application) | 11 | 12 |

*Dyes, opacifiers, perfumes, preservatives, processing aids, stabilizers, solvents, etc The compositions of examples 2 to 5 illustrates further embodiments of the invention.

| | Ex. 2 | Ex. 3 | Ex. 4 | Ex. 5 |
|---|---|---|---|---|
| Alkyl $C_{10-14}$ $Ethoxy_{0.6}$ Sulfate | 17.6 | 18.1 | 17.9 | 17.9 |
| Sodium Alkyl benzene sulfonate | 7.7 | — | — | — |
| Sodium paraffin sulfonate | — | 7.0 | — | — |
| C12-14 dimethyl amine oxide | — | — | 4.1 | 4.1 |
| Cocamido propyl betaine | 1.5 | 2.7 | 5.2 | — |
| Branched Nonionic: | | | | |
| 3-propyl heptanol EO8 | 1.7 | — | — | — |
| 3-propyl heptanol EO3 | — | — | 3.7 | — |
| C11-15 sec. alcohol EO20 | — | 2.0 | — | 3.0 |
| PEI600-EO10-PO7 block polymer | — | — | — | 0.4 |
| Ethanol | 2.0 | 6.5 | 7.0 | 1.0 |
| Propylene glycol | — | 1.5 | 2.8 | — |
| Polypropylene glycol MW2000 | 0.5 | — | — | 0.5 |
| Sodium Chloride | 0.5 | 0.5 | 0.5 | 1.0 |
| Minors* and water | to balance up to 100% | | | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for hand washing dishes, using a liquid detergent composition comprising: from 0.1 to 1.9% by weight of the composition of an ethoxylated 100% branched nonionic surfactant having the formula:

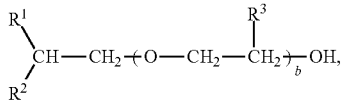

wherein, R1 is a C5 to C16 linear or branched alkyl chain;
R2 is a C1 to C8 linear or branched alkyl chain;
R3 is H;
b is a number from about 7 to about 9; and
from about 5% to about 30%, by weight of the composition, of an ethoxylated anionic surfactant derived from a fatty alcohol, having an average degree of ethoxylation of from about 1 to about 2, wherein at least 90% by weight of the fatty alcohol is linear,
wherein the method comprises the step of contacting the liquid detergent composition in its neat form, with the dishes.

2. The method according to claim 1, wherein said liquid detergent composition in undiluted form is contacted with said dish using a cleaning device or implement selected from the group consisting of a brush, a sponge, a nonwoven material, and a woven material.

3. The method according to claim 1, wherein said nonionic surfactant has from about 8 to about 24 carbon atoms in the branched alkyl chain.

4. The method according to claim 3, wherein said nonionic surfactant has from about 10 to about 14 carbon atoms in the branched alkyl chain.

5. The method according to claim 1, wherein said ethoxylated anionic surfactant is a saturated $C_8$-$C_{16}$ alkyl ethoxysulphate.

6. The method according to claim 1, wherein b is 8.

* * * * *